US012758020B2

(12) United States Patent
Campisi et al.

(10) Patent No.: US 12,758,020 B2
(45) Date of Patent: Oct. 13, 2026

(54) DAMPED HINGE ASSEMBLY FOR STADIUM SEATING

(71) Applicant: Hussey Seating Company, North Berwock, ME (US)

(72) Inventors: Adam Campisi, Biddeford, ME (US); Chi Lam Yau, Dover, NH (US)

(73) Assignee: Hussey Seating Company, North Berwick, ME (US)

( * ) Notice: Subject to any disclaimer, the term of this patent is extended or adjusted under 35 U.S.C. 154(b) by 40 days.

(21) Appl. No.: 18/740,856

(22) Filed: Jun. 12, 2024

(65) Prior Publication Data

US 2025/0089899 A1 Mar. 20, 2025

Related U.S. Application Data

(60) Provisional application No. 63/472,539, filed on Jun. 12, 2023.

(51) Int. Cl.

| | |
|---|---|
| ***A47C 7/58*** | (2006.01) |
| ***A47C 1/121*** | (2006.01) |
| ***A47C 7/56*** | (2006.01) |

(52) U.S. Cl.

CPC ..... *A47C 7/58* (2013.01); *A47C 1/121* (2013.01); *A47C 7/566* (2013.01)

(58) Field of Classification Search

CPC ..... A47C 1/121; A47C 7/56; A47C 7/566; A47C 7/58

See application file for complete search history.

(56) References Cited

U.S. PATENT DOCUMENTS

| | | | | |
|---|---|---|---|---|
| 5,257,852 | A * | 11/1993 | Tsuneki | A47C 1/121 192/208 |
| 6,652,030 | B2 * | 11/2003 | Conner | A47C 7/58 297/332 |
| 7,950,507 | B2 * | 5/2011 | Figueras Mitjans | A47C 1/121 188/290 |
| 7,950,739 | B2 * | 5/2011 | King | A47C 1/121 297/335 |
| 8,016,357 | B2 * | 9/2011 | Figueras Mitjans | A47C 7/58 192/223.4 |
| 9,295,334 | B2 * | 3/2016 | Olarte | A47C 7/58 |
| 9,554,654 | B1 * | 1/2017 | Jung | A47C 7/566 |
| 11,498,684 | B2 * | 11/2022 | Rao | B64D 11/0639 |
| 12,064,035 | B2 * | 8/2024 | Olarte | A47C 1/121 |
| 2010/0213745 | A1 * | 8/2010 | Figueras Mitjans | A47C 1/121 297/340 |
| 2021/0204702 | A1 * | 7/2021 | Harrison | F16C 11/103 |
| 2024/0016294 | A1 * | 1/2024 | Olarte | A47C 1/121 |
| 2024/0335040 | A1 * | 10/2024 | Doyon | A47C 1/121 |

* cited by examiner

*Primary Examiner* — Philip F Gabler

(74) *Attorney, Agent, or Firm* — Robinson + Cole LLP

(57) ABSTRACT

A damped hinge assembly for a self-raising seat bottom for preventing the seat bottom from noticeably bouncing at its topmost position. The damped hinge assembly includes a clutch damping mechanism that is engaged at an intermediate position between its lowered position and topmost position to begin slowing the rotation of the seat bottom. The clutch damping mechanism has a number of adjacent plates with a viscous material disposed between them. When the clutch damping mechanism is engaged the plates rotate against one another and the viscous material applies a drag force that resists the rotation to slow the return of the seat bottom to its upright stored position.

20 Claims, 8 Drawing Sheets

DAMPED HINGE ASSEMBLY FOR STADIUM SEATING

CROSS-REFERENCE TO RELATED APPLICATION

This application claims priority from U.S. Provisional Patent Application No. 63/472,539 titled "DAMPED HINGE ASSEMBLY FOR STADIUM SEATING", which was filed on Jun. 12, 2023, which is incorporated fully herein by reference.

TECHNICAL FIELD

The present invention relates generally to a hinged seat bottom construction for stadium type seating and the like, and more particularly, to a damped hinge assembly that slows the rotation of a self-raising seat bottom.

BACKGROUND INFORMATION

Seating with self-raising seat bottoms is commonly used in venues such as theaters, auditoriums, arenas and stadiums, where the seat bottom flips up once the seat occupant leaves the seat. This self-raising feature functions to maximize the usable space between rows of seating, creating clearer and wider paths along the exit aisle of the row of seats for chair occupants exiting therefrom. FIG. 1 shows an example of such a chair 20 with a seat back 22 and seat bottom 24 held between stanchions 26. Seat bottom 24 is typically pivotally attached to the stanchions 26 at hinge mounts 28 via typical prior art hinges 30. Hinges 30 attach to the seat bottom 24 through a seat bottom plate 25 that is the main load bearing structure of the seat bottom 24. A seat bottom cover is typically placed over the hinges 30 and seat bottom plate 25 so they remain hidden when the seat bottom 24 is flipped to its upright position.

Oftentimes the seat bottom is biased towards its topmost position (shown in FIG. 8A) so that the rows are cleared without relying on an occupant to flip the seat up once they stand up. For example, a biasing mechanism 34, such as a counterweight, torsion spring, or other resilient member, acts on the seat bottom 24 or hinge 30 to urge the seat bottom 24 toward its upright position. However, once released, the prior art seat bottom 24 accelerates upwardly under the force of the biasing mechanism 34 and abruptly meets a rear bumper or stop at its topmost position, creating an unpleasant and distracting noise with each bounce.

Accordingly, there is a need for a hinge assembly that slows the rotation of a self-raising seat bottom to avoid significant and distracting bouncing when the seat bottom abruptly impacts a rotation limiting structure at its topmost position.

A method to control the seat return is also required to prevent the seat from bouncing significantly during return. Additionally, the seat return needed to retain its performance over the life of the product. After several design iterations, a damping clutch mechanism has been developed that provides the desired 'slow and controlled' seat return.

SUMMARY OF THE INVENTION

A damped hinge assembly for an automatically-folding seat bottom for preventing the seat bottom from noticeably bouncing at its topmost position. The damped hinge assembly includes a clutch damping mechanism that is engaged at an intermediate position between its lowered position and topmost position to begin slowing the rotation of the seat bottom. The clutch damping mechanism has a number of adjacent plates with a viscous material disposed between them. When the clutch damping mechanism is engaged the plates rotate against one another and the viscous material applies a drag force that resists the rotation to slow the seat bottom.

As the seat rotates, the clutch mechanism cover contacts the inner seat panel and the clutch slip plates rotate. The clutch mechanism locking plates are pinned to the hinge shaft and do not rotate. Damping grease (the viscous material) between the slip plates and locking plates generate substantial damping force, slowing the seat return.

In one embodiment, the plurality of plates of the clutch pack assembly includes a lock plate, adjacent a first slip plate, adjacent a first mid-plate, adjacent a second slip plate, and adjacent a second mid-plate, and wherein each of the lock plate, first slip plate, first mid-plate, second slip plate, and second mid-plate includes at least one contact surface and wherein prior to assembly of the clutch pack assembly, the viscous damping medium is applied to all contact surfaces of the lock plate, the first and second mid-plates, and first and second slip plates, such that a layer of viscous damping medium is disposed between adjacent plates and between the clutch pack assembly and a back wall of the clutch damper cover, to produce a drag force between adjacent rotating surfaces of the clutch pack assembly.

The summary here is not an exhaustive listing of the novel features described herein, and are not limiting of the claims. These and other features are described in greater detail below.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EXAMPLES

Exemplary embodiments will be described in detail herein and examples of the exemplary embodiments are illustrated in the accompanying drawings. Unless specified otherwise, the same numbers in different accompanying drawings represent the same or similar elements when the accompanying drawings are described hereinafter. The implementation modes described in the following exemplary embodiments do not represent all the implementation modes consistent with the present disclosure. In contrast, they are only examples of devices as recited in the appended claims and consistent with some aspects of the present disclosure.

Figure 1:
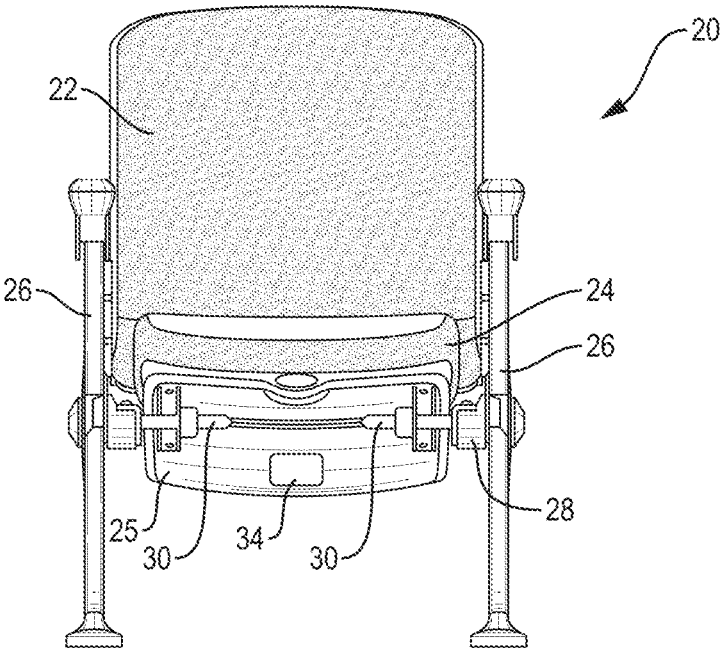
FIG. 1 (PRIOR ART)
FIG. 1 is a front view of chair having hinge mechanisms as known in the prior art.
Figure 2:
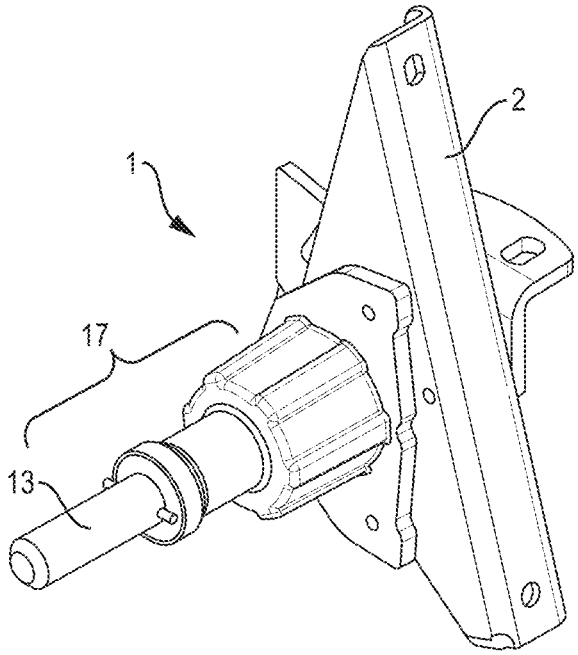
FIG. 2 is an isometric view of an example damping hinge assembly according to the present invention.

FIG. 2 shows an example damped hinge assembly 1 according to the present invention. In order to slow the rotation about hinge axle 13 of a seat bottom plate 25 (not shown for clarity) attached to a seat bottom support 2, a clutch damping mechanism 17 is provided.

Figure 3:
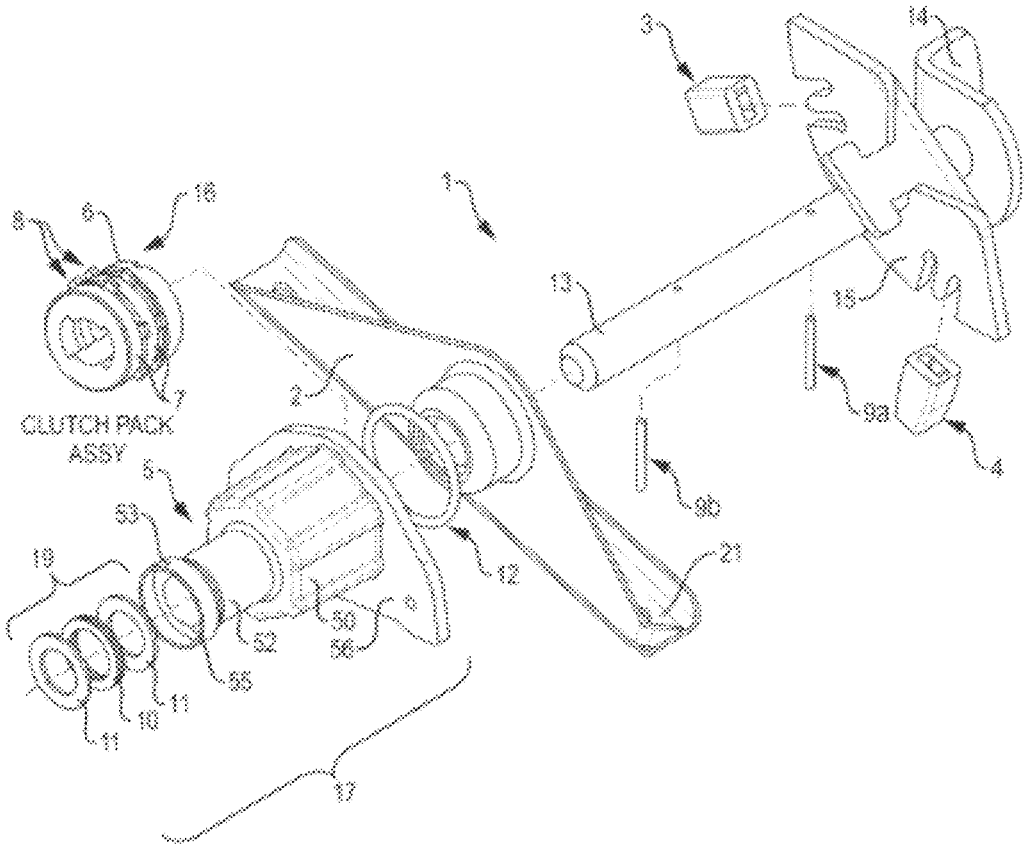
FIG. 3 is an isometric exploded view of the hinge assembly of FIG. 2.
Figure 7A:
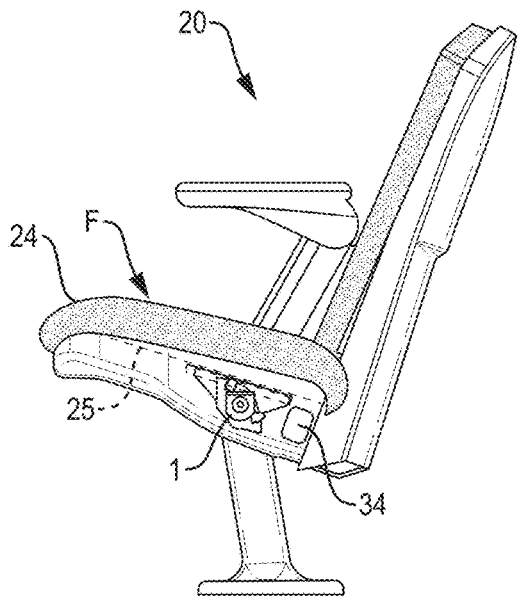
FIG. 7A is a side view of a chair showing a hinge attached to a seat bottom in its lowered position.
Figure 8A:
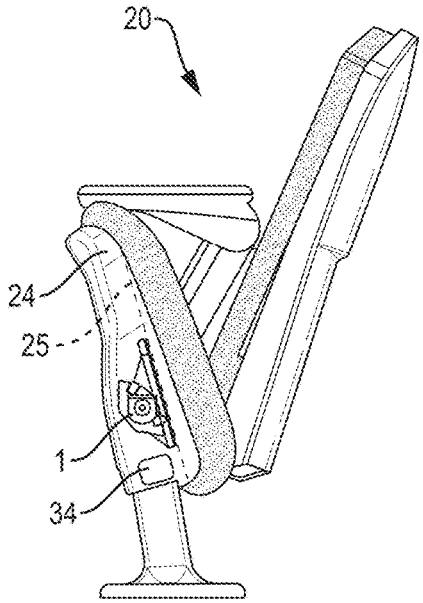
FIG. 8A is a side view of a chair showing a hinge attached to a seat bottom in its topmost position.

FIG. 3 shows exploded view of the damped hinge assembly 1 of FIG. 2. As with the typical hinge assembly 30, this damped hinge assembly 1 includes a hinge bracket 14 rigidly attached to the hinge axle 13. A bumper plate 15 is also rigidly attached to axle 13 and includes a front bumper 3 and a rear bumper 4. A seat bottom support 2 is rotatably mounted on the axle 13 adjacent the bumper plate 15, and is free to rotate about the axle 13 between a lowered position (as shown in FIG. 7A) where the seat bottom support member 21 abuts the front bumper 3 of bumper plate 15, and a raised position (as shown in FIG. 8A) where the seat bottom support member 21 abuts the rear bumper 4 of bumper plate 15. Alternatively, a seat bottom plate 25 attached to the seat bottom support 2 abuts the front bumper 3 and rear bumper 4 at the seat bottom's lowered and raised positions, respectively.

FIG. 3 further shows in an exploded view the clutch damping mechanism 17, which includes a clutch damper cover 5 having a clutch rocker 56 on one end thereof and pressure cup 53 at the opposite end thereof. Clutch damper cover 5 further includes a clutch pack receiver 50 adjacent clutch rocker 56, and an extension 52 separating the clutch pack receiver 50 and pressure cup 53. An O-ring 12 fits between clutch rocker 56 and seat bottom support 2 to provide a seal against foreign material entering the clutch pack receiver 50.

Clutch pack receiver 50 is shaped to receive clutch pack assembly 16. Clutch pack assembly 16 includes a lock plate 6, at least one mid plate 7, and at least one slip plate 8. During assembly, lock plate 6 is installed on hinge axle 13 such that a registration pin 9*a*, which extends through the axle 13, mates with a registration channel 18 in lock plate 6 (see FIG. 4) in a manner that prevents both further translation along the axle 13 towards hinge bracket 14, as well as preventing relative rotation between the lock plate 6 and axle 13. While registration pin 9*a* is shown as a cylindrical pin inserted through a cylindrical hole in the axle 13, any structure that prevents both translational and rotational movement of the lock plate, such as a set screw or registration surface formed integrally with the axle, would work as well.

Figure 5:
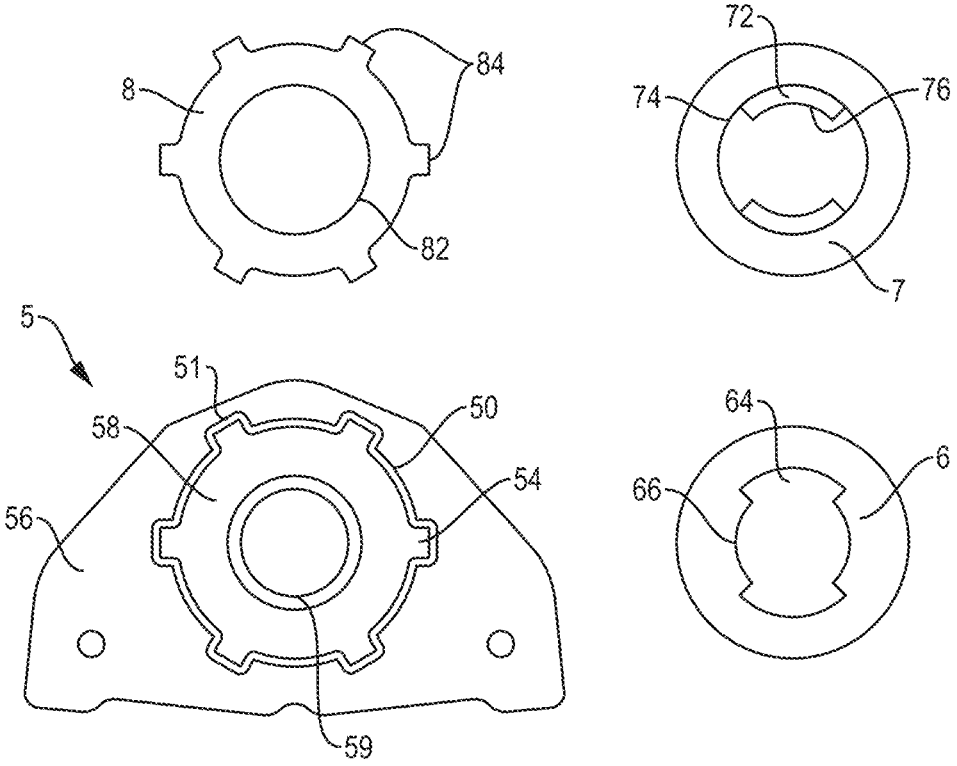
FIG. 5 is a front view of the clutch damper cover, slip plate, and mid plate of FIG. 4.
Figure 6:
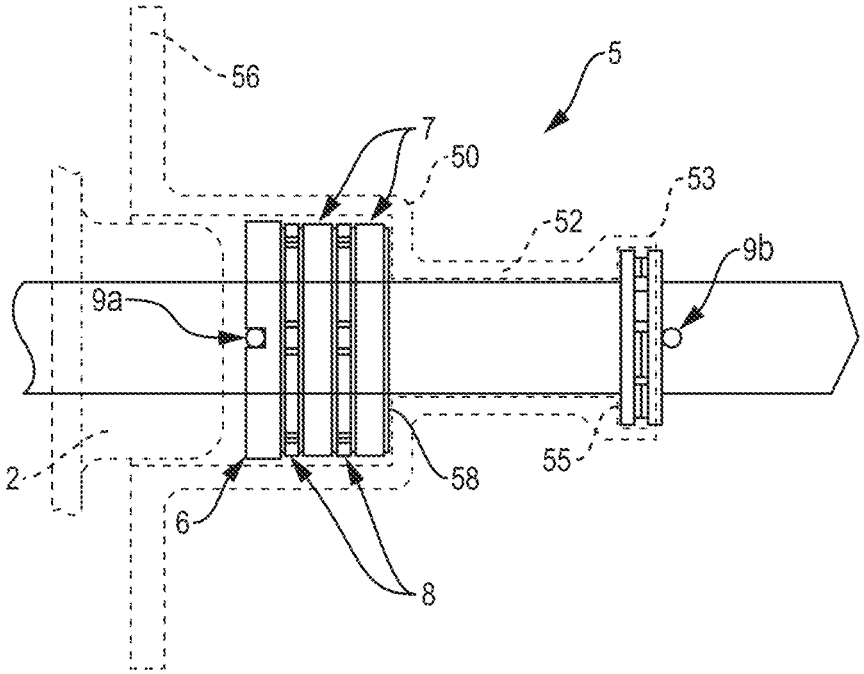
FIG. 6 is a side view of a partially assembled clutch damping mechanism.

The remaining mid and slip plates of clutch pack assembly 16 are slid against lock plate 6, and the clutch damper cover 5 is slid over the clutch pack assembly 16 until a back wall 58 of the clutch pack receiver 50 abuts the clutch pack assembly 16 (see FIGS. 5 and 6).

Compression pack assembly 19 is provided adjacent to and pressed against bearing surface 55 of pressure cup 53. As described in more detail below, the purpose of the compression pack assembly 19 is to apply and maintain a desired amount of force against the clutch damper cover 5, which in turn compresses the clutch pack assembly 16 disposed therein. Once compression pack assembly 19 is pressed against bearing surface 55, pressure pin 9*b* is inserted through the axle 13 to restrain axial movement of the compression pack assembly along the axle in a direction away from hinge bracket 14 and to maintain the pressure of compression pack assembly 19.

The composition of compression pack assembly 19 can be altered to provide a desired amount of pressure along the axis of the axle 13, as well as to provide a desired amount of rotational resistance to the clutch damper cover 5. In some examples, the desired amount of rotational resistance is as close to zero as possible to allow free rotation of the clutch damper cover 5 against the compression pack assembly. In other examples, a non-zero amount of rotational resistance is desired to add additional rotational resistance to a self-raising seat bottom. In some examples, compression pack assembly 19 incudes a biasing member 10 having a spacer 11 on each side thereof. The material and thickness of the spacers 11 are chosen to provide a desired compressive force and rotational resistance. For example, thicker spacers 11 act to increase distance between pressure pin 9*b* and bearing surface 55. Additionally, spacers made of a resilient material, such as an elastomeric compound or soft polymer, will offer more "give" to allow for greater tolerances between the bearing surface 55 and pressure pin 9*b*. In some examples, spacers 11 are made from a low friction material such as polytetrefluoroethylene (PTFE), polyethylene terephthalate (PET), nylon, acetal, polymide or similar low-friction, dimensionally stable material.

The type and size of biasing member 10 is likewise chosen to provide desired compressive properties (compression ratio, spring constant, wear characteristics, geometry, etc.) for a given distance between bearing surface 55 and pressure pin 9*b* and desired amount of compressive force acting on clutch pack assembly 16.

For example, biasing member 10 can be a metal or plastic wave spring washer, an elastomeric disc, a conical spring, or a helical compression spring. In some examples, two or more biasing members 10 of the same or different type are installed adjacent pressure cup 53 to apply a desired amount of pressure to the pressure cup 53 and clutch pack assembly 16.

Figure 4:
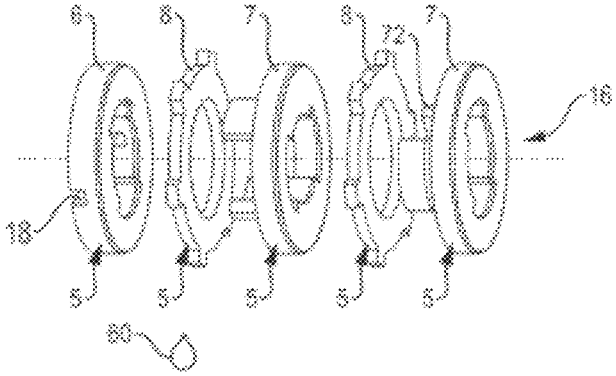
FIG. 4 is an isometric exploded view of the clutch pack assembly shown in FIG. 6.

In the example of FIG. 4, clutch pack assembly 16 includes a lock plate 6, followed by a first slip plate 8, followed by a first mid-plate 7, then by a second slip plate 8 and a second mid-plate 7. Prior to assembly of the clutch pack assembly 16, a viscous damping medium 60 is applied to all contact surfaces S of the lock plate 6, mid plates 7, and slip plates 8, such that a layer of viscous damping medium 60 is contained between adjacent plates and between the clutch pack assembly 16 and the back wall 58 of the clutch damper cover 5 to produces a desired amount of drag force between adjacent relatively rotating surfaces. In this configuration, the plates and viscous damping medium 60 act as a viscous clutch in which shear forces acting between the plates increase as a function of angular velocity, applying a greater braking drag force the faster the relative angular velocity becomes.

Specific properties of a viscous damping medium, such as, for example, the density and kinetic velocity, can be chosen to produce desired results. Examples of viscous damping media include gels and greases. In some examples, the viscous damping medium 60 is a synthetic hydrocarbon grease that is applied at an amount of 1 ml of grease to each surfaces "S" to produce a desired amount of drag force between rotating plates. In some examples, the viscous damping medium 60 is a synthetic hydrocarbon grease that is applied at a thickness of 0.5-1 mm thick.

Referring to FIG. 5, lock plate 6 includes an aperture shaped to fit snugly onto the axle 13 at inner portions 66 thereof, and to allow projections 72 of mid plate 7 to pass therethrough at outer portions 64 thereof. Likewise, mid plates 7 also include an aperture to receive the axle 13 at inner portions 76 thereof and projections 72 of any additional closest mid plate at outer portions 74 of the aperture. Slip plates 8 include a central aperture 82 sized to accommodate projections 72 such that slip plate 8 can spin freely around the projections 72.

When the clutch pack assembly 16 is assembled, projections 72 of mid plates 7 are inserted into the outer portions 64/74 of the preceding lock plate 6 or mid plate 7, are rotationally locked thereto. Thus, when lock plate 6 is engaged with registration pin 9*a* to rotationally fix the lock plate 6 to the hinge axle 13, projections 72 of the next-adjacent mid plate 7 engaged within the outer portions 64 of the aperture of lock plate 6, that mid plate 7 is also rotationally fixed in relation to the axle 13. Because the central aperture 82 of slip plate 8 is sized to slip over mid plate projections 72, slip plate 8 is able to rotate freely despite the lock plate 6 and mid plate 7 being rotationally fixed. Similarly, a second slip plate 8 slid over second projections 72 of a second mid plate 7 is also able to freely rotate thereon when the second projections 72 of the second mid plate 7 are introduced into and rotationally locked within the outer portions 74 of the first mid plate 7 aperture.

As shown in FIG. 5, clutch pack receiver 50 of clutch damper cover 5 is shaped to accommodate projections 84 of a slip plate 8 within inner recesses 54 corresponding to the projections 51 of clutch pack receiver 50 when the clutch damper cover 5 is slid over the clutch pack assembly 16. Clutch damper cover 5 is held onto the hinge axle 13 through its axle aperture 59 that extends through extension 52 of clutch damper cover 5. In some examples, the inner recess 54 and back wall 58 of the clutch damper cover 5 are the only parts of the clutch damper cover 5 that make contact with the clutch pack assembly 16, as each of the lock plate 6, mid plates 7, and slip plates 8 and the clutch damper cover 5 are coaxially aligned on the hinge axle 13, constraining movement normal to the longitudinal axis of the axle.

FIG. 6 is a side view of an assembled clutch damping mechanism 17 with clutch damper cover 5 and seat bottom support 2 shown in ghost. As discussed above, registration pin 9*a* fixes the lock plate 6 from relative axial and rotational movement with respect to the hinge axle 13, following mid plates 7 are each also rotationally and axially fixed by virtue of the interlocking engagement of their respective projections 72 into the outer portions of preceding lock plate 6 or mid plate 7, as illustrated in FIG. 6. Slip plates 8 held between the stationary lock plate 6 and mid plates 7 rotate along with the clutch damper cover 5 around the hinge axle 13.

Back wall 58 of clutch pack receiver 50 is pressed against the clutch pack assembly 16 by the force of spacers 11 and biasing member 10 pressing against bearing surface 55 of pressure cup 53 and secured as such by pressure pin 9*b*. The amount of compressive force upon the clutch pack assembly 16 affects the shear properties of the viscous damping medium 60 as the layer thickness thereof is reduced the greater the applied compressive force.

The side view of FIG. 7A shows chair 20 with its seat bottom 24 in its lowered position, such as when it is occupied by a user. The weight of the user on the seat bottom, transmitted from an internal seat bottom plate 25 to the hinge 30, overcomes the force of the biasing mechanism 34 to prevent rotation of the seat bottom.

Figure 7B:
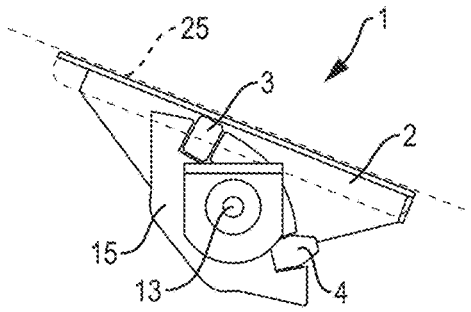
FIG. 7B is a close-up view of the hinge shown in FIG. 7A.
Figure 8B:
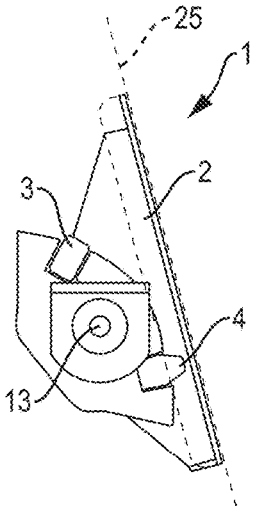
FIG. 8B is a close-up view of the hinge shown in FIG. 8A.

Details of the basic functioning of hinge assembly 1 are shown in FIGS. 7 and 8. FIGS. 7A and 8A are side cutaway views of a chair 20 showing hinge assembly 1 attached to the seat bottom plate 25 of seat bottom 24. In FIG. 7A, seat bottom 24 is shown in its lowered position where a force F upon the seat bottom 24 at one side of hinge assembly 1 (such as when the seat 20 is occupied) acts to rotate the seat bottom downwards and exceeds the force of the biasing member 34 acting to rotate the seat bottom upwards. FIG. 7B shows a close-up of the hinge 1 of FIG. 7A, where the seat bottom support 2, via seat bottom plate, is being pressed against the front bumper 3 of bumper plate 15. FIG. 8A shows the seat bottom 24 of seat 20 in an unoccupied state, where the force from biasing member 34 causes the seat bottom 24 to rotate about hinge axle 13 via the interaction of the hinge assembly 1 and the seat bottom plate 25. Shown in more detail in FIG. 8B, seat bottom support 2 and seat bottom plate 25 are rotated until the seat bottom support 2 makes contact with the rear bumper 4 of bumper plate 15 at the upright, or topmost, position of seat bottom 24, after the force of the counterweight 34 caused the seat bottom to accelerate upwards. The clutch damping mechanism 17 of the present invention reduces the speed of the seat bottom return to reduce noise generation and seat bounce. Put another way, The clutch damping mechanism 17 acts to slow the rotation of the seat bottom as it approaches the topmost position of FIG. 8A to avoid a loud and forceful impact against rear bumper 4, as described in more detail with regards to FIGS. 9A-9D.

Figure 9A:
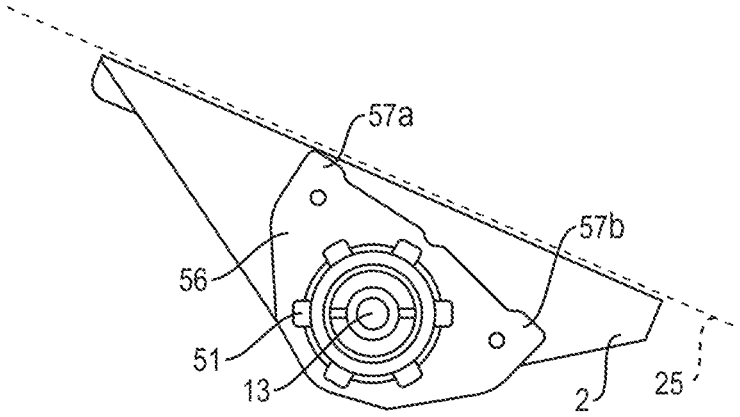
FIGS. 9A-9D are side views of a damping hinge assembly in various positions.
Figure 9B:
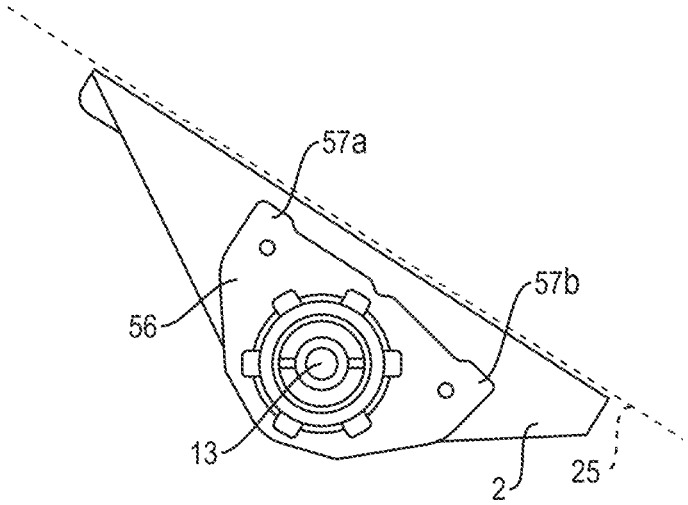

FIGS. 9A-9D show various positions of the damped hinge assembly 1 as the seat bottom (via seat bottom plate 25) is rotated upward by the force applied thereto by biasing mechanism 34. When the seat bottom 24 is rotated downward, the seat bottom plate 25 contacts the front projection 57*a* of clutch rocker 56 and maintains contact therewith as long as the seat bottom 24 remains occupied or otherwise in its lowered position. As the seat bottom plate 25 and seat bottom support 2 begin to rotate upwards about hinge axle 13, the seat bottom plate 25 loses contact with the front projection 57*a* and begins rotating toward projection 57*b* of the clutch rocker 56, as shown in FIG. 9B. At this point the clutch damper cover 5 does not rotate around the hinge axle 13 as there is no significant force applied thereto to cause such rotation.

Figure 9C:
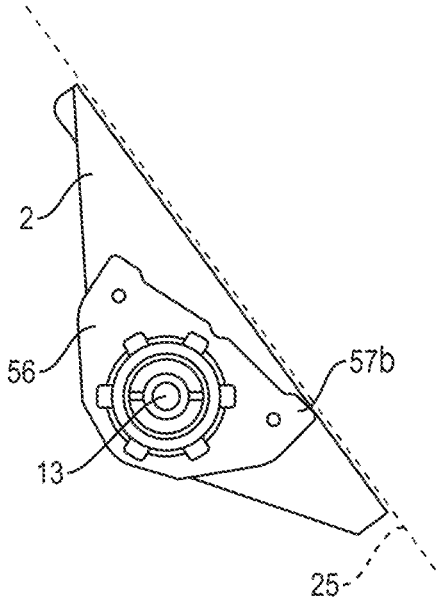

As the seat bottom plate 25 and seat bottom support 2 continue to rotate about hinge axle 13, the seat bottom plate 25 contacts the rear projection 57*b* of clutch rocker 56 at the position of FIG. 9C. By the time the seat bottom plate 25 reaches this position, the biasing member 34 has accelerated the seat bottom to a first angular velocity. Once the rear projection 57*b* of clutch rocker 56 is engaged by the seat bottom plate 25, the clutch damper cover 5 is pushed around the hinge axle 13, and the slip plate projections 84 are engaged by the inner recesses 54 of projections 51 to rotate the slip plates 8 with respect to the stationary lock plate 6 and mid plates 7.

The achieved angular velocity of the seat bottom 24 upon to point of engagement with the clutch damping cover translates into a respective braking drag force acting on the slip plates 8 due to the shearing of the viscous damping medium 60 within the clutch pack mechanism 16. As the angular velocity of the seat bottom 24 decreases in response to the shear forces applied within the clutch pack assembly 16 by viscous damping medium 60, the braking force applied to the seat bottom plate 25 by the clutch damper cover 5 decreases, smoothly slowing the rotation of the seat bottom 24 to a desired angular velocity until the seat boom support 2 comes to rest against the front bumper 4 of the bumper plate 15. The slowed speed should be dialed in to prevent noticeable bouncing and associated noise therefrom.

The point at which the rear projection 57*b* of the clutch rocker 56 is contacted by the seat bottom plate 25 can be adjusted to be able to achieve a high enough angular velocity to quickly clear the exit row while still being able to be slowed to a desired rate via the clutch damping mechanism 17. In some examples, the seat rotates sixty degrees between the lowest and uppermost seat bottom positions, and the clutch damping mechanism 17 is engaged after forty-five degrees of upward rotation. In some examples, clutch damping mechanism is engaged at a point mid-way between the lowermost and uppermost seat bottom positions.

Figure 9D:
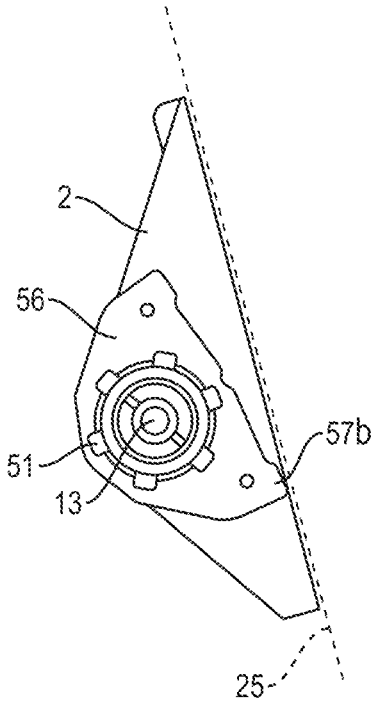
Figure 10A:
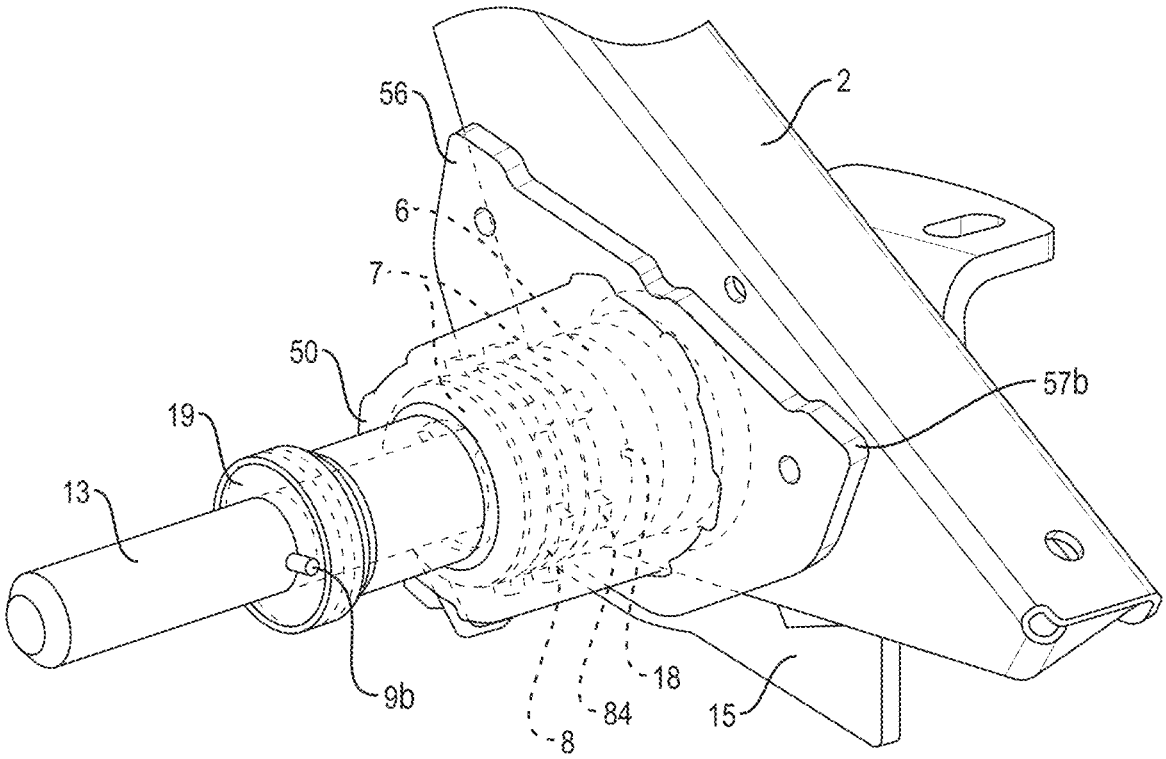
FIGS. 10A and 10B are isometric views of the damping hinge assembly in the two sequential positions of FIGS. 9C and 9D, respectively.
Figure 10B:
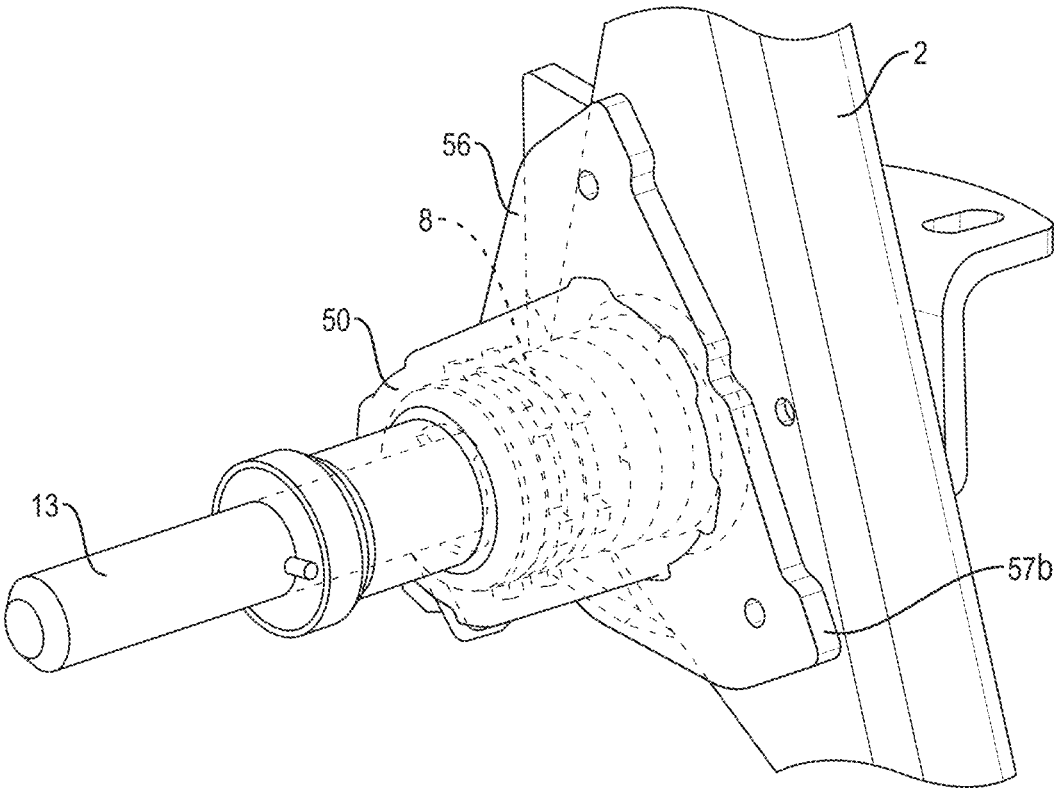

FIGS. 10A and 10B show isometric views of the damping hinge assembly 1 in the positions of FIGS. 9C and 9D, respectively. The clutch damper cover 5 is shown in a transparent manner to allow a view of the slip plates 8 that are rotated by virtue of registration of their projections 84 into the inner recesses 54 of projections 51. Lock plate 6 is prevented from rotating about the axle 13 by registration pin 9*a*. Mid plates 7 are prevented from rotating about axle 13 by virtue of being interlocked with the lock plate 6 through mid-plate projections 72.

Figure 11:
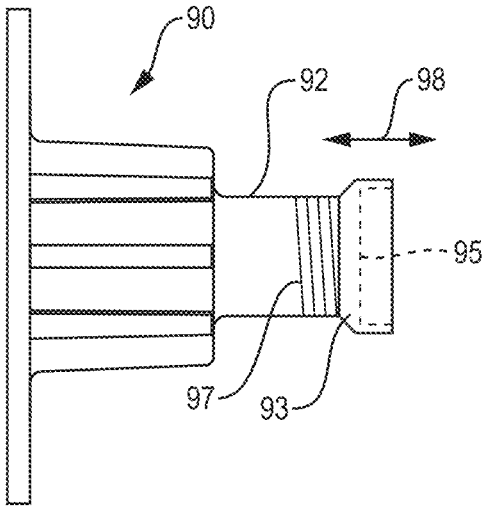
FIG. 11 a front view of an example of an adjustable clutch damper cover.

FIG. 11 shows an example of an adjustable clutch damper cover 90, where extension 92 includes threading 97 that correspond to threading within pressure cup 93 to allow pressure cup 93 to be moved forward and backwards in directions 98. This adjustability allows modification of the force applied by the clutch damper cover 90 to a clutch pack assembly 16 disposed therein. By changing the relative distance of bearing surface 95 and the registration pin 9*a*, clutch damper cover 90 can employ a single set of spacers 11 and or biasing members 10 to achieve a desired compressive force upon a clutch patch assembly held within the clutch damper cover 90.

A theater seat 80 can include either one damped hinge assembly 1 and one basic hinge assembly 30, or can include two damped hinge assembles 1, depending on the action of biasing member 34 on seat bottom 84, and the required damping to sufficiently slow the seat bottom 84 as it nears its topmost position.

Accordingly, the present invention a damped hinge assembly for a self-raising seat bottom for preventing the seat bottom from noticeably bouncing at its topmost position upon release from its in-use downward position.

The present invention is not intended to be limited to a device or method which must satisfy one or more of any stated or implied objects or features of the invention and should not be limited to the preferred, exemplary, or primary example(s) described herein.

Modifications and substitutions by one of ordinary skill in the art are considered to be within the scope of the present invention, which is not to be limited except by the allowed claims and their legal equivalents.

INDEX OF REFERENCE NUMBERS

1 hinge assembly
2 seat bottom support
3 front bumper
4 rear bumper
5 clutch damper cover
6 lock plate
7 mid plate
8 slip plate
9*a* registration pin
9*b* pressure pin
10 biasing member
11 spacer
12 O-ring
13 hinge axle
14 hinge bracket
15 bumper plate
16 clutch pack assembly
17 clutch damping mechanism
18 registration channel
19 compression pack assembly
20 fold-down seating
21 seat bottom support member
22 seat back
24 seat bottom
25 seat bottom plate
26 stanchion
28 hinge mount
30 basic hinge
34 biasing member
50 clutch pack receiver
51 projections
52 extension
53 pressure cup
54 inner recesses
55 bearing surface
56 clutch rocker
57*a* front projection
57*b* rear projection
58 back wall
59 axle aperture
60 viscous damping medium
64 outer portions
66 inner portions
72 mid plate projection
74 outer portions
76 inner portions
82 central aperture
84 projections
90 clutch damper cover
92 extension
93 pressure cup
95 bearing surface
97 threads
98 adjustment direction
S contact surfaces

The invention claimed is:

1. A damped hinge assembly configured to slow a seat bottom having a seat plate as it rotates about an axle from a lower position towards a topmost position, the damped hinge assembly comprising:

a clutch pack assembly having:
- a plurality of plates disposed about said axle and stacked against one another; and
- a viscous damping medium, disposed between said plurality of plates; and a clutch damper cover having:
- a clutch pack receiver; and
- a clutch plate having a front projection and a rear projection;

whereby, upon rotation of the seat bottom to an intermediate position between the lowermost position and the topmost position, one of said front projection or said rear projection of said clutch plate is contacted by a seat bottom plate causing the clutch damper cover to rotate therewith; and wherein, upon rotation of the clutch damper cover, the interior of the clutch pack receiver cooperates with one or more of the plurality of plates of the clutch pack assembly to rotate at a different speed from the other plates; and wherein shear forces created by the action of rotation of the plurality of plates within the clutch pack assembly on said viscous damping medium disposed therebetween acts to slow the rotation of the seat bottom through contact with the seat bottom plate by the clutch plate.

2. The damped hinge assembly of claim 1 wherein said plurality of plates of said clutch pack assembly includes a lock plate, which is adjacent a first slip plate, which is adjacent a first mid-plate, which is adjacent a second slip plate, which is adjacent a second mid-plate, and wherein each of said lock plate, first slip plate, first mid-plate, second slip plate, and second mid-plate includes at least one contact surface and wherein prior to assembly of said clutch pack assembly, said viscous damping medium is applied to all contact surfaces of the lock plate, the first and second mid-plates, and first and second slip plates, such that a layer of viscous damping medium is disposed between adjacent plates and between the clutch pack assembly and a back wall of the clutch damper cover to produce a drag force between adjacent rotating surfaces of said clutch pack assembly.

3. The damped hinge assembly of claim 1, further comprising a registration pin extending through said axle and mating with a registration channel in a lock plate of said plurality of plates, wherein said registration pin prevents both translational movement of said lock plate along said axle and relative rotation between said lock plate and said axle.

4. The damped hinge assembly of claim 3, wherein said plurality of plates further includes at least one mid plate having projections that are received within outer portions of an aperture of said lock plate such that said at least one mid plate is rotationally fixed with respect to said axle by virtue of interlocking engagement with said lock plate, and at least one slip plate having a central aperture sized to accommodate said projections of said at least one mid plate such that said at least one slip plate rotates freely about said projections when said clutch damper cover rotates.

5. The damped hinge assembly of claim 1, further comprising an O-ring disposed between a clutch rocker of said clutch damper cover and a seat bottom support rotatably mounted on said axle, said O-ring providing a seal against foreign material entering said clutch pack receiver.

6. The damped hinge assembly of claim 1, wherein said clutch pack receiver includes inner recesses, and wherein at least one slip plate of said plurality of plates includes projections received within said inner recesses such that rotation of said clutch damper cover causes said at least one slip plate to rotate therewith while a lock plate and at least one mid plate of said plurality of plates remain rotationally fixed with respect to said axle.

7. The damped hinge assembly of claim 1, wherein said clutch plate includes said front projection and said rear projection, and wherein said clutch damper cover does not rotate about said axle until said seat bottom plate contacts said rear projection at an intermediate rotational position of said seat bottom, and wherein said intermediate rotational position is adjustable to permit said seat bottom to achieve a first angular velocity prior to engagement of said clutch damper cover.

8. The damped hinge assembly of claim 1, further comprising a compression pack assembly disposed adjacent a bearing surface of a pressure cup of said clutch damper cover, said compression pack assembly including at least one biasing member and at least one spacer, said compression pack assembly configured to apply and maintain a compressive force against said pressure cup, which in turn compresses said clutch pack assembly within said clutch pack receiver through a back wall thereof, and a pressure pin extending through said axle to restrain axial movement of said compression pack assembly in a direction away from said clutch pack assembly and to maintain said compressive force, wherein said compressive force affects a layer thickness of said viscous damping medium between adjacent plates of said plurality of plates such that a greater compressive force reduces said layer thickness and increases shear resistance during relative rotation of said plurality of plates.

9. A damped hinge assembly for a seat comprising:

a clutch pack assembly having a plurality of plates disposed about an axle and stacked against one another, and a viscous damping medium disposed between said plurality of plates; and a clutch damper cover having a clutch pack receiver sized to receive said clutch pack assembly, an extension extending from said clutch pack receiver, and a pressure cup disposed at an end of said extension opposite said clutch pack receiver, wherein said extension includes a first thread and said pressure cup includes a second thread configured to mate with the first thread such that said pressure cup is movable along said extension in a direction parallel to a longitudinal axis of said axle by relative rotation between said pressure cup and said extension, thereby adjusting a compressive force applied by a back wall of said clutch pack receiver against said clutch pack assembly disposed therein; and a clutch plate associated with said clutch damper cover and having a front projection and a rear projection, whereby, upon rotation of a seat bottom to an intermediate position between a lowermost position and a topmost position, one of said front projection or said rear projection is contacted by a seat bottom plate causing said clutch damper cover to rotate therewith, wherein, upon rotation of said clutch damper cover, the interior of said clutch pack receiver cooperates with one or more of said plurality of plates to rotate at a different speed from other of said plurality of plates, and wherein shear forces created by relative rotation of said plurality of plates on said viscous damping medium act to slow the rotation of said seat bottom through contact with said seat bottom plate by said clutch plate.

10. The damped hinge assembly of claim 9, further comprising a compression pack assembly disposed adjacent a bearing surface of said pressure cup, said compression pack assembly including at least one biasing member and at least one spacer, wherein adjustment of said pressure cup along said second thread changes a relative distance between said bearing surface and a pressure pin extending through said axle, thereby permitting said at least one spacer and said at least one biasing member to achieve a range of compressive forces upon said clutch pack assembly without replacement of said at least one spacer or said at least one biasing member.

11. The damped hinge assembly of claim 9, wherein said compressive force applied by said back wall against said clutch pack assembly affects a layer thickness of said viscous damping medium between adjacent plates of said plurality of plates, and wherein a greater compressive force reduces said layer thickness and increases shear resistance of said viscous damping medium during relative rotation of said plurality of plates, thereby increasing a braking drag force applied to said seat bottom.

12. The damped hinge assembly of claim 9, wherein said plurality of plates includes a lock plate rotationally fixed to said axle by a registration pin extending through said axle and mating with a registration channel in said lock plate, at least one mid plate rotationally fixed to said lock plate by interlocking projections received within outer portions of an aperture of said lock plate, and at least one slip plate rotatable with respect to said lock plate and said at least one mid plate, and wherein said clutch pack receiver includes inner recesses that engage projections of said at least one slip plate such that said at least one slip plate rotates with said clutch damper cover.

13. The damped hinge assembly of claim 9, further comprising an O-ring disposed between a clutch rocker of said clutch damper cover and a seat bottom support rotatably mounted on said axle, said O-ring providing a seal against foreign material entering said clutch pack receiver.

14. The damped hinge assembly of claim 9, wherein said clutch damper cover does not rotate about said axle until said seat bottom plate contacts said rear projection of said clutch plate at an intermediate rotational position of said seat bottom between said lowermost position and said topmost position, and wherein said intermediate rotational position is located such that said seat bottom achieves a first angular velocity under a force of a biasing mechanism prior to engagement of said clutch damper cover, and wherein said shear forces created upon engagement progressively decrease as the angular velocity of said seat bottom decreases.

15. A damped hinge assembly for a seat comprising:

a clutch pack assembly having a plurality of plates disposed about an axle and stacked against one another, and a viscous damping medium disposed between said plurality of plates;

a clutch damper cover having a clutch pack receiver sized to receive said clutch pack assembly, and a pressure cup;

a compression pack assembly disposed adjacent a bearing surface of said pressure cup, said compression pack assembly including at least one biasing member and at least one spacer disposed on at least one side of said at least one biasing member, said compression pack assembly configured to apply and maintain a compressive force against said pressure cup, which in turn compresses said clutch pack assembly within said clutch pack receiver through a back wall thereof;

a pressure pin extending through said axle to restrain axial movement of said compression pack assembly in a direction away from said clutch pack assembly and to maintain said compressive force; and a clutch plate associated with said clutch damper cover and having a front projection and a rear projection, whereby, upon rotation of said seat bottom to an intermediate position between a lowermost position and said topmost position, one of said front projection or said rear projection is contacted by a seat bottom plate causing said clutch damper cover to rotate therewith, wherein, upon rotation of said clutch damper cover, the interior of said clutch pack receiver cooperates with one or more of said plurality of plates to rotate at a different speed from other of said plurality of plates, and wherein shear forces created by relative rotation of said plurality of plates on said viscous damping medium act to slow the rotation of said seat bottom through contact with said seat bottom plate by said clutch plate.

16. The damped hinge assembly of claim 15, wherein said at least one spacer includes polytetrefluoroethylene or polyethylene terephthalate.

17. The damped hinge assembly of claim 15, wherein a material and a thickness of said at least one spacer are selected to provide a desired compressive force and a desired amount of rotational resistance of said clutch damper cover against said compression pack assembly, and wherein in at least one configuration said desired amount of rotational resistance is substantially zero.

18. The damped hinge assembly of claim 15, wherein said compressive force applied by said compression pack assembly through said pressure cup and said back wall against said clutch pack assembly reduces a layer thickness of said viscous damping medium between adjacent plates of said plurality of plates, and wherein said reduced layer thickness increases shear resistance of said viscous damping medium during relative rotation of said plurality of plates.

19. The damped hinge assembly of claim 15, wherein said compression pack assembly includes two or more biasing members disposed adjacent said pressure cup, said two or more biasing members cooperating to apply a desired amount of compressive force to said pressure cup and said clutch pack assembly.

20. The damped hinge assembly of claim 15, wherein said at least one spacer includes a spacer disposed on each side of said at least one biasing member, and wherein said spacers made of a resilient material provide compliance to accommodate tolerances between said bearing surface of said pressure cup and said pressure pin while maintaining said compressive force upon said clutch pack assembly.

* * * * *